US010962894B2

(12) United States Patent
Itou et al.

(10) Patent No.: US 10,962,894 B2
(45) Date of Patent: Mar. 30, 2021

(54) DECOLORIZABLE TONER, TONER CARTRIDGE, IMAGE FORMING APPARATUS, DECOLORIZING SYSTEM, DECOLORIZING METHOD, AND DECOLORIZING DEVICE

(71) Applicant: TOSHIBA TEC KABUSHIKI KAISHA, Tokyo (JP)

(72) Inventors: Tsuyoshi Itou, Shizuoka (JP); Takafumi Hara, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/750,421

(22) Filed: Jan. 23, 2020

(65) Prior Publication Data

US 2020/0159138 A1 May 21, 2020

Related U.S. Application Data

(62) Division of application No. 16/158,979, filed on Oct. 12, 2018.

(51) Int. Cl.

| | |
|---|---|
| ***G03G 15/20*** | (2006.01) |
| ***G03G 9/09*** | (2006.01) |
| ***G03G 9/097*** | (2006.01) |
| ***G03G 15/08*** | (2006.01) |
| ***G03G 9/083*** | (2006.01) |
| ***G03G 9/087*** | (2006.01) |

(52) U.S. Cl.

CPC ..... *G03G 9/0926* (2013.01); *G03G 9/0833* (2013.01); *G03G 9/08755* (2013.01); *G03G 9/0928* (2013.01); *G03G 9/09708* (2013.01); *G03G 9/09733* (2013.01); *G03G 15/0877* (2013.01); *G03G 15/2039* (2013.01)

(58) Field of Classification Search

CPC ..... G03G 9/0926; G03G 9/09708; G03G 9/0833; G03G 9/09733; G03G 9/08755; G03G 9/0928; G03G 15/2039; G03G 15/0877

See application file for complete search history.

(56) References Cited

U.S. PATENT DOCUMENTS

| | | | |
|---|---|---|---|
| 2009/0087767 | A1 | 4/2009 | Nakamura |
| 2009/0154970 | A1 | 6/2009 | Yoshida et al. |

OTHER PUBLICATIONS

Diamond, A.S., ed. "Handbook of Imagining Materials", Marcel Dekker, Inc., NY, 1991, p. 161.

Non-Final Office Action on U.S. Appl. No. 16/158,979 dated Jan. 31, 2020.

*Primary Examiner* — Mark A Chapman

(74) *Attorney, Agent, or Firm* — Foley & Lardner LLP

(57) ABSTRACT

A decolorizable toner allows for easy distinguishing between a sheet which can be reused and a sheet which is hardly able to be reused from each other. The decolorizable toner includes a color developable compound, a color developing agent, a decolorizing agent, a magnetic material, and a binder resin. The color developable compound is a precursor compound of a dye. The color developing agent is an electron accepting compound which donates a proton to the color developable compound. The decolorizing agent is a compound which inhibits a coloring reaction between the color developable compound and the color developing agent.

3 Claims, 4 Drawing Sheets

DECOLORIZABLE TONER, TONER CARTRIDGE, IMAGE FORMING APPARATUS, DECOLORIZING SYSTEM, DECOLORIZING METHOD, AND DECOLORIZING DEVICE

CROSS REFERENCE TO RELATED APPLICATIONS

This application is a divisional of U.S. patent application Ser. No. 16/158,979 filed Oct. 12, 2018, the entire contents of which are incorporated herein by reference in its entirety.

FIELD

Embodiments described herein relate generally to a decolorizable toner, a toner cartridge, an image forming apparatus, a decolorizing system, a decolorizing method, and a decolorizing device.

BACKGROUND

There is a decolorizable toner which is decolorized by heating. A method of reusing a sheet printed with a decolorizable toner is proposed. In an actual use environment, a sheet printed with a decolorizable toner and a sheet printed with a toner which is not decolorized by heating are often present mixedly. Therefore, it is necessary to separate the sheet printed with a decolorizable toner and the sheet printed with a toner which is not decolorized by heating from each other.

The separation of these sheets is performed by scanning the sheets after heating with a decolorizing machine or the like, and then distinguishing whether the sheets are in a reusable state or by visual observation.

DETAILED DESCRIPTION

Figure 1:
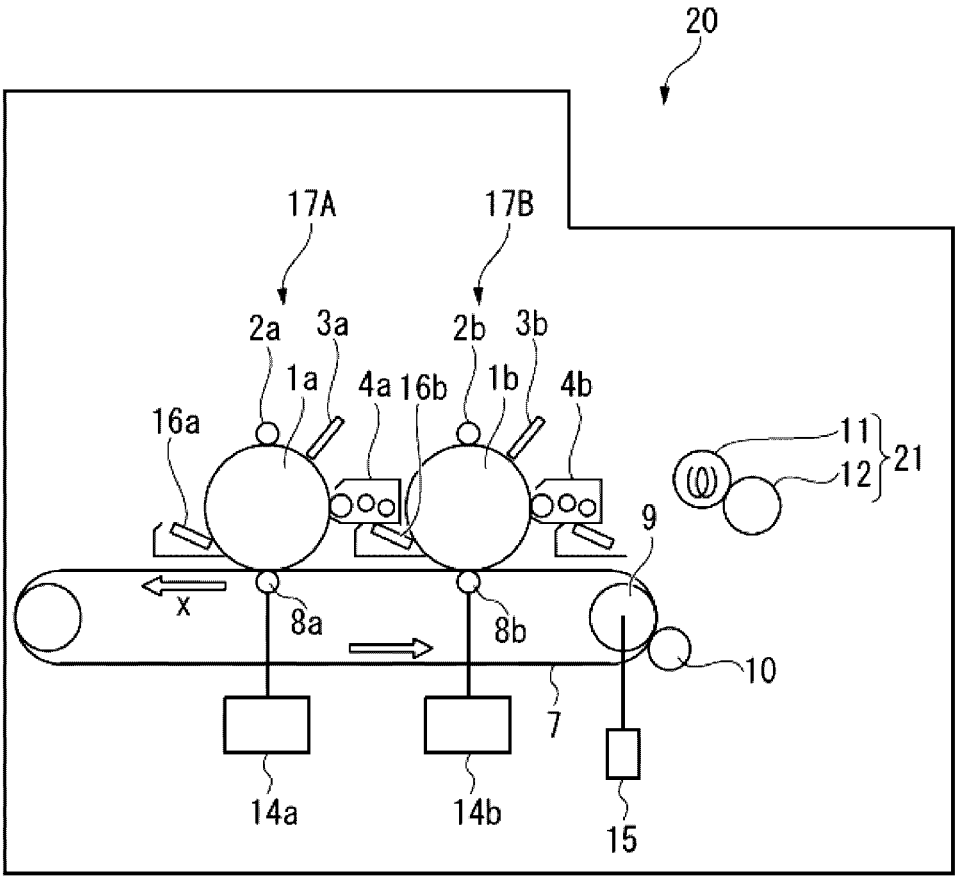
FIG. 1 shows an image forming apparatus according to some embodiments.

As noted above, a separation of sheets may be performed by scanning the sheets after heating with a decolorizing machine or the like, and then distinguishing whether the sheets are in a reusable state or by visual observation. However, it may take time to perform the separation by scanning or visual observation. Therefore, the users' convenience may be deteriorated. In addition, distinguishing whether the sheets are in a reusable state after heating requires thermal energy for heating.

In view of this, a decolorizable toner capable of easily distinguishing a sheet which can be reused and a sheet which is hardly reused from each other is desired.

A decolorizable toner according to some embodiments includes a color developable compound, a color developing agent, a decolorizing agent, a magnetic material, and a binder resin. The color developable compound is a precursor compound of a dye. The color developing agent is an electron accepting compound which donates a proton to the color developable compound. The decolorizing agent is a compound which inhibits a coloring reaction between the color developable compound and the color developing agent.

Hereinafter, the decolorizable toner of some embodiments will be described.

The "decolorization" in some embodiments means that an image formed with a color (including not only a chromatic color, but also an achromatic color such as white or black) which is different from the base color of a sheet is made invisible.

As the decolorizable toner of some embodiments, a decolorizable toner including toner particles containing a color developable compound, a color developing agent, a decolorizing agent, a magnetic material, and a binder resin is exemplified.

The magnetic material will be described.

The magnetic material is a compound which imparts magnetism to the decolorizable toner of some embodiments. In some embodiments, the magnetic material imparts magnetism to toner particles. The color of the magnetic material is preferably white from the viewpoint of a residual image after decolorization. As the white magnetic material, a surface-treated material of titanium oxide particles is exemplified.

As a surface treatment method for titanium oxide particles, there is a method for adhering magnetic iron oxide particles to titanium oxide particle cores. One example of the method for adhering magnetic iron oxide particles to the titanium oxide particle cores is described in JP-A-2003-2658. As the surface treatment method for titanium oxide particles, there is also a method for forming a metallic silver coating on the surface of a magnetic powder. One example of the method for forming a metallic silver coating on the surface of a magnetic powder is described in JP-A-3-274278. As the magnetic powder, magnetic metals such as metallic iron, metallic cobalt, and metallic nickel; alloys of these metals; magnetite, manganese ferrite, etc. are exemplified in JP-A-3-274278.

The content of the magnetic material is preferably from 1 to 10 mass %, more preferably from 2 to 9 mass %, furthermore preferably from 3 to 7 mass % with respect to 100 mass % of the decolorizable toner of some embodiments. When the content of the magnetic material is 1 mass % or more, it becomes easy to distinguish whether or not a sheet printed with the decolorizable toner of some embodiments can be reused. When the content of the magnetic material is 10 mass % or less, a residual image after decolorization hardly occurs.

The color developable compound will be described.

The color developable compound is a precursor compound of a dye. The color developable compound is an electron donating compound which develops a color by reacting with the color developing agent. As a representative component of the color developable compound, a leuco dye is exemplified. Examples of the leuco dye include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples of the leuco dye include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-

3-(1-ethyl-2-methyli ndol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino) fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl) quinoline, spiro[5H-(1)benzopyrano(2,3-d)pyrimidine-5,1'(3'H)isobenzo furan]-3'-one, 2-(diethylamino)-8-(diethylamino)-4-methyl-, spiro[5H-(1)benzopyrano(2,3-d) pyrimidine-5,1'(3'H)isobenzo furan]-3'-one, 2-(di-n-butylamino)-8-(di-n-butylamino)-4-methyl-, spiro[5H-(1) benzopyrano(2,3-d)pyrimidine-5,1'(3'H)isobenzo furan]-3'-one, 2-(di-n-butylamino)-8-(diethylamino)-4-methyl-, spiro [5H-(1)benzopyrano(2,3-d)pyrimidine-5,1'(3'H)isobenzo furan]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzo furan]-3'-one, 2-(di-n-butylamino)-8-(di-n-butylamino)4-phenyl, 3-(2-methoxy-4-dimethylaminophenyl)-3-(1-butyl-2-methylind ol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindo l-3-yl)-4,5,6,7-tetrachlorophthalide. Additional examples thereof include pyridine-based compounds, quinazoline-based compounds, and bisquinazoline-based compounds. As the color developable compound, one type may be used alone or two or more types may be used in combination.

The content of the color developable compound is preferably from 0.1 to 5.0 mass %, more preferably from 0.2 to 3.0 mass %, furthermore preferably from 0.3 to 1.0 mass % with respect to 100 mass % of the decolorizable toner. When the content of the color developable compound is 0.1 mass % or more, the coloring action of the decolorizable toner of some embodiments is improved. When the content of the color developable compound is 5.0 mass % or less, the decolorizing action of the decolorizable toner of some embodiments is improved.

The color developing agent will be described.

The color developing agent is an electron accepting compound that donates a proton to the color developable compound. Examples of the color developing agent include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole and derivatives thereof, bisphenols, trisphenols, and phenol-aldehyde condensed resins. These electron accepting compounds may have a substituent. Examples of the substituent include an alkyl group, an aryl group, an acyl group, an alkoxycarbonyl group, a carboxy group and an ester or an amide group thereof, and a halogen group.

Specific examples of the color developing agent include phenol, o-cresol, tert-butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid and esters thereof, 2,3-dihydroxybenzoic acid, methyl 3,5-dihydroxybenzoate, resorcin, gallic acid, dodecyl gallate, ethyl gallate, butyl gallate, propyl gallate, 2,2-bis(4-hydroxyphenyl) propane, 4,4-dihydroxydiphenylsulfone, 1,1-bis (4-hydroxyphenyl) ethane, 2,2-bis (4-hydroxy-3-methylphenyl) propane, bis (4-hydroxyphenyl) sulfide, 1-phenyl-1,1-bis (4-hydroxyphenyl) ethane, 1,1-bis (4-hydroxyphenyl)-3-methylbutane, 1,1-bis (4-hydroxyphenyl)-2-methylpropane, 1,1-bis (4-hydroxyphenyl) n-hexane, 1,1-bis (4-hydroxyphenyl) n-heptane, 1,1-bis (4-hydroxyphenyl) n-octane, 1,1-bis (4-hydroxyphenyl) n-nonane, 1,1-bis (4-hydroxyphenyl) n-decane, 1,1-bis (4-hydroxyphenyl) n-dodecane, 2,2-bis (4-hydroxyphenyl) butane, 2,2-bis (4-hydroxyphenyl) ethylpropionate, 2,2-bis (4-hydroxyphenyl)-4-methylpentane, 2,2-bis (4-hydroxyphenyl) hexafluoropropane, 2,2-bis (4-hydroxyphenyl) n-heptane, 2,2-bis (4-hydroxyphenyl)n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetrio l, 4,6-bis[(3,5-dimethyl-4-hydroxyphenyl)methyl]-1,2,3-benzen etriol, 4,4'-[1,4-phenylenebis(1-methylethylidene)bis (benzene-1,2,3-triol)], 4,4'-[1,4-phenylenebis(1-methylethylidene)bis(1,2-benzened iol)], 4,4',4"-ethylidenetrisphenol, 4,4'-(1-methylethylidene)bisphenol, and methylenetris-p-cresol. As the color developing agent, one type may be used alone, or two or more types may be used in combination.

The content of the color developing agent is preferably from 0.1 to 5.0 mass %, more preferably from 0.2 to 3.0 mass %, furthermore preferably from 0.3 to 1.0 mass % with respect to 100 mass % of the decolorizable toner. When the content of the color developing agent is 0.1 mass % or more, the coloring action of the decolorizable toner of some embodiments is improved. When the content of the color developing agent is 5.0 mass % or less, the decolorizing action of the decolorizable toner of some embodiments is improved.

The decolorizing agent will be described.

The decolorizing agent is a compound which inhibits a coloring reaction between the color developable compound and the color developing agent by heat in a mixture of a three-component system including the color developable compound, the color developing agent, and the decolorizing agent. The decolorizing agent can decolorize the mixture of the three-component system.

As the decolorizing agent, a compound capable of using temperature hysteresis is particularly preferred. Examples of the compound capable of using temperature hysteresis are described in JP-A-60-264285, JP-A-2005-1369, and JP-A-2008-280523.

A coloring and decolorizing mechanism using temperature hysteresis has an excellent instantaneous erasing property. The coloring and decolorizing mechanism uses a color change temperature regulator as the decolorizing agent. The color change temperature regulator is a substance which has a large temperature difference (which may be a predetermined temperature difference or a value that is a predetermined temperature difference or more) between the melting point and the solidifying point. When the color change temperature regulator is heated to a temperature equal to or higher than the melting point, the color change temperature regulator decolorizes an image. When the color change temperature regulator is cooled, the decolorized state is maintained until the temperature reaches the solidifying point. When the solidifying point of the color change temperature regulator is equal to or lower than normal temperature, the decolorized state is maintained even at normal temperature.

When the mixture of the three-component system in a colored state is heated to a temperature equal to or higher than a decolorizing temperature (Th), the mixture is transformed into a decolorized state. Further, even if the mixture in a decolorized state is cooled to a temperature equal to or lower than Th, the decolorized state is maintained. When the temperature of the mixture is further decreased, the coloring reaction between the color developable compound and the color developing agent occurs again at a color restoring temperature (Tc) or lower. As a result, the mixture of the three-component system returns to a colored state. In this manner, the mixture of the three-component system can cause reversible coloring and decolorizing reactions. In particular, the color change temperature regulator is preferably a compound which satisfies the following relationship: Th>Tr>Tc wherein Tr represents room temperature.

Examples of the color change temperature regulator include alcohols, esters, ketones, ethers, and acid amides. Among these, esters are particularly preferred.

Specific examples of the esters include esters of a carboxylic acid containing a substituted aromatic ring, esters of a carboxylic acid containing an unsubstituted aromatic ring with an aliphatic alcohol, esters of a carboxylic acid containing a cyclohexyl group in a molecule, esters of a fatty acid with an unsubstituted aromatic alcohol or a phenol, esters of a fatty acid with a branched aliphatic alcohol, esters of a dicarboxylic acid with an aromatic alcohol or a branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. As the decolorizing agent, one type may be used alone, or two or more types may be used in combination.

The content of the decolorizing agent is preferably from 1 to 10 mass %, more preferably from 2 to 8 mass %, furthermore preferably from 4 to 7 mass % with respect to 100 mass % of the decolorizable toner. When the content of the decolorizing agent is 1 mass % or more, the decolorizing action of the decolorizable toner of some embodiments is improved. When the content of the decolorizing agent is 10 mass % or less, the coloring action of the decolorizable toner of some embodiments is improved.

The decolorizable toner of some embodiments preferably includes capsule particles. The capsule particles enclose three components: the color developable compound, the color developing agent, and the decolorizing agent with an encapsulating agent. Examples of the encapsulating agent include a polyvalent isocyanate prepolymer and a melamine formalin prepolymer. When the decolorizable toner of some embodiments contains the above-mentioned three components as the capsule particles, the effect of the chemical action between the above-mentioned three components and components other than the above-mentioned three components is prevented.

As the capsule particles, microcapsules are preferred. The microcapsules are capsular particles having a diameter in the order of micrometers. By using microcapsules as the capsule particles, the coloring action and the decolorizing action of the decolorizable toner of some embodiments are improved.

The volume average particle diameter of the microcapsules is preferably from 0.10 to 10 μm, more preferably from 0.5 to 5 μm. When the volume average particle diameter of the microcapsules is 0.10 μm or more, a coloring ability is further enhanced. Further, when the volume average particle diameter of the microcapsules is 10 μm or less, an image with a favorable image quality is easily formed.

The binder resin will be described.

Examples of the binder resin include a polyester resin, a polystyrene resin, a polyurethane resin, and an epoxy resin. Among these, a polyester resin is preferred because the low-temperature fixability is excellent. As the polyester resin, a polycondensation product of a divalent carboxylic acid component and a dihydric alcohol component is preferred.

Examples of the divalent carboxylic acid component include aromatic dicarboxylic acids such as terephthalic acid, phthalic acid, and isophthalic acid, and aliphatic carboxylic acids such as fumaric acid, maleic acid, succinic acid, adipic acid, sebacic acid, glutaric acid, pimelic acid, oxalic acid, malonic acid, citraconic acid, and itaconic acid. As the divalent carboxylic acid component, one type may be used alone or two or more types may be used in combination.

Examples of the dihydric alcohol component include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol, and alicyclic diols such as 1,4-cyclohexanediol and 1,4-cyclohexanedimethanol, and ethylene oxide adducts or propylene oxide adducts of bisphenol A or the like. As the dihydric alcohol component, one type may be used alone or two or more types may be used in combination.

The polyester resin may be formed into a crosslinked structure using a polyvalent carboxylic acid component such as 1,2,4-benzenetricarboxylic acid (trimellitic acid) and a polyhydric alcohol component such as glycerin. As the polyester resin, one type may be used alone or two or more types of polyester resins having different compositions may be used in combination.

The glass transition temperature (Tg) of the polyester resin is preferably from 40 to 70° C., more preferably from 45 to 65° C. When the glass transition temperature of the polyester resin is 40° C. or higher, the storage stability of the decolorizable toner of some embodiments is improved. When the glass transition temperature of the polyester resin is 70° C. or lower, the fixability of the decolorizable toner of some embodiments is improved. The glass transition temperature (Tg) of the polyester resin can be measured by differential scanning calorimetry.

The polyester resin may be amorphous or crystalline.

The decolorizable toner of some embodiments may contain a component (optional component) other than the color developable compound, the color developing agent, the decolorizing agent, the magnetic material, and the binder resin. Examples of the optional component include a release agent, a surfactant, an aggregating agent, a charge control agent, an external additive, a basic compound, and a silane coupling agent.

The decolorizable toner of some embodiments preferably contains a release agent from the viewpoint of improving the fixability and the like.

Examples of the release agent include low molecular weight polyethylene, low molecular weight polypropylene, polyolefin copolymers, aliphatic hydrocarbon-based waxes such as polyolefin wax, microcrystalline wax, paraffin wax, and Fischer-Tropsch wax; oxides of aliphatic hydrocarbon-based waxes such as polyethylene oxide wax, or block copolymers thereof; vegetable waxes such as candelilla wax, carnauba wax, Japan wax, jojoba wax, and rice wax; animal waxes such as bees wax, lanolin, and spermaceti wax; mineral waxes such as ozokerite, ceresin, and petrolactum; waxes containing a fatty acid ester as a main component such as montanic acid ester wax and castor wax; compounds obtained by partially or entirely deoxidizing a fatty acid ester such as deoxidized carnauba wax; saturated straight-chain fatty acids such as palmitic acid, stearic acid, montanic acid, and long chain alkyl carboxylic acids containing a longer chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long chain alkyl alcohols containing a longer chain alkyl group; polyhydric alcohols such as sorbitol; fatty acid amides such as linoleic acid amide, oleic acid amide, and lauric acid amide; saturated fatty acid bisamides such as methylene bisstearic acid amide, ethylene biscapric acid amide, ethylene bislauric acid amide, and hexamethylene bisstearic acid amide; unsaturated fatty acid amides such as ethylene bisoleic acid amide, hexamethylene bisoleic acid amide, N,N'-dioleyl adipic acid amide, and N,N'-dioleyl sebacic acid amide; aromatic bisamides such as m-xylene bisstearic acid amide and N,N'-distearyl isophthalic acid amide; fatty acid metal salts (compounds generally called "metal soap") such as calcium stearate, calcium laurate, zinc stearate, and magnesium stearate; waxes prepared by grafting an aliphatic hydrocarbon-based wax using a vinyl-based monomer such as styrene or acrylic acid; partially esterified products of a fatty acid with a polyhydric alcohol such as behenic acid monoglyceride; and methyl ester compounds having a hydroxyl group obtained by hydrogenation of a vegetable oil. As the release agent, one type may be used alone or two or more types may be used in combination.

Examples of the surfactant include anionic surfactants such as sulfuric acid ester salts, sulfonic acid salts, phosphoric acid ester salts, and soaps; cationic surfactants such as amine salts and quaternary ammonium salts; and nonionic surfactants such as polyethylene glycol-based, alkyl phenol ethylene oxide adduct-based, and polyhydric alcohol-based nonionic surfactants. These surfactants may be polymers.

Examples of the aggregating agent include metal salts such as sodium chloride, calcium chloride, calcium nitrate, barium chloride, magnesium chloride, zinc chloride, magnesium sulfate, aluminum chloride, aluminum sulfate, and potassium aluminum sulfate; nonmetal salts such as ammonium chloride and ammonium sulfate; inorganic metal salt polymers such as polyaluminum chloride, polyaluminum hydroxide, and calcium polysulfide; polymeric aggregating agents such as polymethacrylic acid esters, polyacrylic acid esters, polyacrylamides, and acrylamide-sodium acrylate copolymers; coagulating agents such as polyamines, polydiallyl ammonium halides, polydiallyl dialkyl ammonium halides, melanin formaldehyde condensates, and dicyandiamide; alcohols such as methanol, ethanol, 1-propanol, 2-propanol, 2-methyl-2-propanol, 2-methoxyethanol, 2-ethoxyethanol, and 2-butoxyethanol; organic solvents such as acetonitrile and 1,4-dioxane; inorganic acids such as hydrochloric acid and nitric acid; and organic acids such as formic acid and acetic acid. Among these, nonmetal salts are preferred because the effect of accelerating aggregation is high, and ammonium sulfate is more preferred.

Examples of the charge control agent include metal-containing azo compounds and metal-containing salicylic acid derivative compounds. Among the metal-containing azo compounds, a complex or a complex salt in which the metal is iron, cobalt, or chromium, and a mixture of these metal-containing azo compounds are preferred. Among the metal-containing salicylic acid derivative compounds, a complex or a complex salt in which the metal is zirconium, zinc, chromium, or boron and a mixture of these metal-containing salicylic acid derivative compounds are preferred.

The external additive may be used for imparting fluidity to the toner particles, adjusting chargeability, or the like. The external additive is a component to be added to the surfaces of the toner particles. As the external additive, inorganic fine particles may be used. Examples of the inorganic material making up the inorganic fine particles include silica, titania, alumina, strontium titanate, and tin oxide. As the inorganic fine particles, one type may be used alone or two or more types may be used in combination.

As the external additive, from the viewpoint of improving the environmental stability, a surface-treated material of the inorganic fine particles with a hydrophobizing agent are preferred.

As the external additive, resin fine particles having a particle diameter of 1 μm or less may be used for improving the cleaning property. Examples of the resin making up the resin fine particles include a styrene-acrylic acid copolymer, polymethyl methacrylate, and a melamine resin.

The content of the external additive is preferably from about 0.01 to 20 mass % with respect to 100 mass % of the decolorizable toner of some embodiments.

A method for producing the decolorizable toner of some embodiments will be described.

In the method for producing the decolorizable toner, capsule particles may be produced. The capsule particles are obtained by encapsulating a core component containing a color developable compound, a color developing agent, and a decolorizing agent with a shell component. Examples of the encapsulation method include an interfacial polymerization method, a coacervation method, an in-situ polymerization method, an in-liquid drying method, and an in-liquid curing coating method. Among these, an in-situ polymerization method using a melamine resin as the shell component, or an interfacial polymerization method using a urethane resin as the shell component is particularly preferred.

In the case of an in-situ polymerization method, first, the color developable compound, the color developing agent, and the decolorizing agent are dissolved and mixed, and then emulsified in an aqueous solution of a water-soluble polymer or a surfactant. Thereafter, an aqueous solution of a melamine-formalin prepolymer is added thereto, followed by polymerization by heating, whereby encapsulation can be achieved.

In the case of an interfacial polymerization method, the above-mentioned three components and a polyvalent isocyanate prepolymer are dissolved and mixed, and then emulsified in an aqueous solution of a water-soluble polymer or a surfactant. Thereafter, a polyvalent base such as a diamine or a diol is added thereto, followed by polymerization by heating, whereby encapsulation can be achieved.

Subsequently, a dispersion liquid of the capsule particles and a dispersion liquid of fine particles containing a binder resin, and in some embodiments, a dispersion liquid of fine particles containing a release agent are mixed. During this mixing, in some embodiments, an aggregating agent such as ammonium sulfate may be added. The aggregating agent aggregates the fine particles under heating conditions. In some embodiments, a fusion stabilizing agent such as an aqueous solution of sodium polycarboxylate may be added. Thereafter, it is preferred to accelerate the fusion of the aggregated particles by gradually increasing the temperature to about 100° C. while stirring.

Subsequently, the aggregated and fused toner particles are washed with an aqueous medium such as water. Examples of the washing method include a centrifugation method and a filter press method. Among these, in a filter press method, air blow can be performed while performing compression. Therefore, a filter press method is particularly preferred from the viewpoint that the amount of water (water content) in a toner cake after washing can be easily adjusted.

The toner cake after washing is dried until the amount of water is decreased to 0.1 to 2 mass %. Examples of the drying method include a tray-type decompression drying method, a Nauta-type decompression drying method, a conical-type decompression drying method, a vibration fluidizing method, and a flash jet method. Among these, a flash jet method is particularly preferred from the viewpoint that the production efficiency is high.

To the dried toner particles, an external additive may be externally added.

The external additive is mixed with the dried toner particles using, for example, a mixer. The external additive may be sieved using a sieving device so as to sieve out coarse particles or the like as needed. The sieving device is not particularly limited as long as the device is configured to be able to sieve out coarse particles.

The decolorizable toner of some embodiments is used as a one-component developer or a two-component developer in combination with a carrier. According to the decolorizable toner of some embodiments, when a sheet is printed with the decolorizable toner of some embodiments, a decolorizable toner image having magnetism is formed on the sheet. The decolorizable toner image imparts magnetism to the sheet after printing. As a result, by distinguishing a sheet using magnetism, a sheet which can be reused and a sheet which is hardly reused can be easily distinguished from each other.

Hereinafter, a toner cartridge of some embodiments will be described.

In the toner cartridge of some embodiments, the decolorizable toner of some embodiments is housed in a container. The container is not particularly limited.

When the toner cartridge of some embodiments is used in an image forming apparatus, and an image is formed, a decolorizable toner image is formed on a sheet. As a result, magnetism is imparted to the sheet, and therefore, a sheet which can be reused can be easily distinguished.

Hereinafter, an image forming apparatus of some embodiments will be described with reference to the drawing.

In the image forming apparatus of some embodiments, the decolorizable toner of some embodiments is housed in an apparatus main body. As the apparatus main body, a general electrophotographic apparatus is used.

FIG. 1 is a diagram showing an exemplary schematic structure of the image forming apparatus of some embodiments.

An image forming apparatus 20 of some embodiments includes an apparatus main body. The apparatus main body includes an intermediate transfer belt 7, a first image forming unit 17A, a second image forming unit 17B, and a fixing device 21. The first image forming unit 17A and the second image forming unit 17B are provided in this order on the intermediate transfer belt 7. The fixing device 21 is provided downstream of the first image forming unit 17A.

The first image forming unit 17A is provided downstream of the second image forming unit 17B along the traveling direction X of the intermediate transfer belt 7, that is, the forward direction of the image forming process.

The first image forming unit 17A includes a photoconductive drum 1*a*, a cleaning device 16*a*, a charging device 2*a*, an exposure device 3*a*, a first developing device 4*a*, and a primary transfer roller 8*a*. The cleaning device 16*a*, the charging device 2*a*, the exposure device 3*a*, and the first developing device 4*a* are provided in this order along the rotational direction of the photoconductive drum 1*a*. The primary transfer roller 8*a* is provided on the photoconductive drum 1*a* so as to face the photoconductive drum 1*a* through the intermediate transfer belt 7.

The second image forming unit 17B includes a photoconductive drum 1*b*, a cleaning device 16*b*, a charging device 2*b*, an exposure device 3*b*, a second developing device 4*b*, and a primary transfer roller 8*b*. The cleaning device 16*b*, the charging device 2*b*, the exposure device 3*b*, and the second developing device 4*b* are provided in this order along the rotational direction of the photoconductive drum 1*b*. The primary transfer roller 8*b* is provided on the photoconductive drum 1*b* so as to face the photoconductive drum 1*b* through the intermediate transfer belt 7.

In the first developing device 4*a* and the second developing device 4*b*, a developer containing the decolorizable toner of some embodiments is housed. The decolorizable toner of some embodiments may be configured to be supplied from a toner cartridge of some embodiments (not shown).

To the primary transfer roller 8*a*, a primary transfer power supply 14*a* is connected. To the primary transfer roller 8*b*, a primary transfer power supply 14*b* is connected.

On the downstream side of the first image forming unit 17A, a secondary transfer roller 9 and a backup roller 10 are disposed so as to face each other through the intermediate transfer belt 7. To the secondary transfer roller 9, a secondary transfer power supply 15 is connected.

The fixing device 21 includes a heat roller 11 and a press roller 12 disposed so as to face each other.

Image formation is performed, for example, as follows using the image forming apparatus 20.

First, the photoconductive drum 1*b* is uniformly charged by the charging device 2*b*. Then, light exposure is performed by the exposure device 3*b*, thereby forming an electrostatic latent image. Then, the electrostatic latent image is developed with a toner supplied from the developing device 4*b*, thereby forming a second toner image.

Subsequently, the photoconductive drum 1*a* is uniformly charged by the charging device 2*a*. Then, light exposure is performed based on first image information (second toner image) by the exposure device 3*a*, thereby forming an electrostatic latent image. Then, the electrostatic latent image is developed with the decolorizable toner of some embodiments supplied from the developing device 4*a*, thereby forming a first toner image.

The second toner image and the first toner image are transferred in this order onto the intermediate transfer belt 7 using the primary transfer rollers 8*a* and 8*b*.

An image obtained by stacking the second toner image and the first toner image in this order on the intermediate transfer belt 7 is secondarily transferred onto a sheet (recording medium) (not shown) through the secondary transfer roller 9 and the backup roller 10. By doing this, an image in which the first toner image and the second toner image are stacked in this order is formed on the sheet.

The sheet having the toner image transferred thereto is conveyed to the fixing device 21. The sheet is pressurized and also heated to a temperature (fixing temperature) lower than the decolorizing temperature (Th) when passing between the heat roller 11 and the press roller 12. By doing this, the toner image is fixed to the sheet in a colored state.

The image forming apparatus shown in FIG. 1 is configured to fix a toner image, however, the image forming apparatus of some embodiments is not limited to this configuration.

The type of the color developable compound, etc. used in the decolorizable toner of some embodiments in the developing device 4*a* and the developing device 4*b* is arbitrarily selected. The image forming apparatus 20 shown in FIG. 1 includes two developing devices, however, may include three or more developing devices depending on the type of the color developable compound, etc. to be used.

According to the image forming apparatus of some embodiments, a decolorizable toner image having magnetism is formed on a sheet. As a result, magnetism is imparted to the sheet, and therefore, a sheet which can be reused can be easily distinguished.

Hereinafter, a decolorizing system of some embodiments will be described. The decolorizing system of some embodiments includes a separating device (separator) and a decolorizing device (decolorizer). The separating device separates a sheet having a specific image formed thereon. The specific image includes a fixed material of the decolorizable toner of some embodiments.

The separating device included in the decolorizing system of some embodiments will be described with reference to the drawing.

Figure 2:
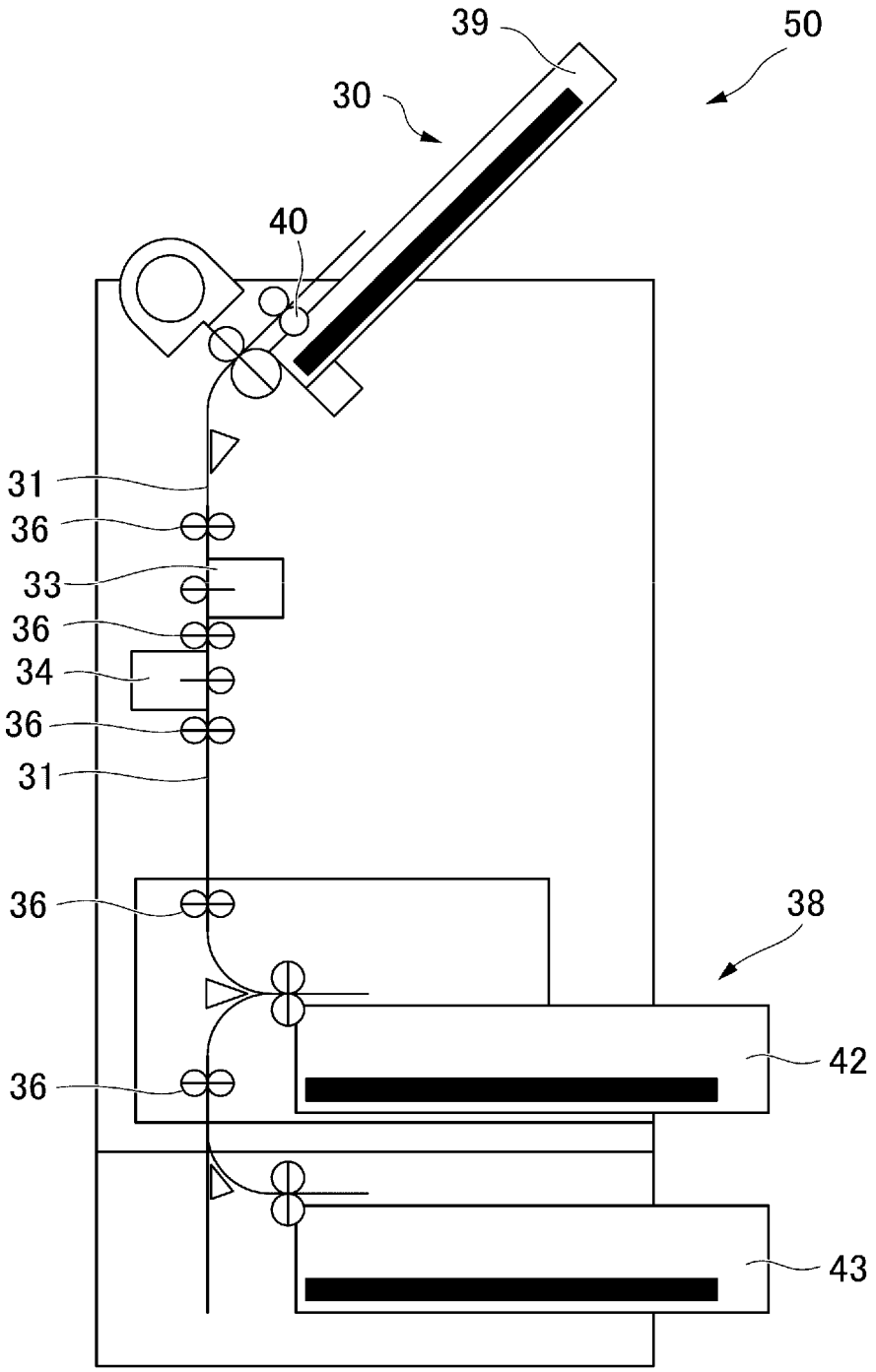
FIG. 2 shows a separating device including a decolorizing system according to some embodiments.

FIG. 2 is a diagram showing an exemplary schematic structure of the separating device included in the decolorizing system of some embodiments. A separating device (separator) 50 allows for sorting and includes a paper feed portion 30, a first conveyance path 31, a first distinguishing portion 33, a second distinguishing portion 34, and a paper discharge portion 38.

The paper feed portion 30 feeds a sheet into the separating device 50. The paper feed portion 30 includes a paper feed tray 39 and a pick-up roller 40. The paper feed tray 39 loads sheets. In the paper feed tray 39, a first sheet and a second sheet are present mixedly. The first sheet is a sheet printed with the decolorizable toner of some embodiments. Therefore, on the first sheet, an image including a fixed material of the decolorizable toner of some embodiments is formed. Further, to the first sheet, magnetism is imparted. The second sheet is a sheet printed with a toner other than the decolorizable toner of some embodiments. Therefore, on the second sheet, an image including a fixed material of the decolorizable toner of some embodiments is not formed.

The pick-up roller 40 takes out sheets one by one from the paper feed tray 39, and sends out the sheets to the first conveyance path 31 (hereinafter, the sheet conveyed from the paper feed tray 39 is referred to as "conveyance sheet"). The first conveyance path 31 includes a plurality of conveyance rollers 36. Each conveyance roller 36 may include a driving roller and driven roller pair.

The first conveyance path 31 is connected to the paper discharge portion 38 from the paper feed portion 30. The first conveyance path 31 includes a pair of the first distinguishing portion 33 and the second distinguishing portion 34. The first distinguishing portion 33 and the second distinguishing portion 34 distinguish whether or not an image including a fixed material of the decolorizable toner of some embodiments is formed on a conveyance sheet using a magnetic sensor. That is, the first distinguishing portion 33 and the second distinguishing portion 34 distinguish whether the conveyance sheet is the first sheet or the second sheet.

The first distinguishing portion 33 and the second distinguishing portion 34 each include a magnetic sensor (not shown). The first distinguishing portion 33 and the second distinguishing portion 34 may include a plurality of magnetic sensors.

The magnetic sensor detects magnetism of the conveyance sheet. The magnetic sensor is preferably capable of detecting the maximum width of the conveyance sheet. The magnetic sensor is preferably a contactless sensor which performs high-speed detection of a magnetic ink, a magnetic card, or the like.

The magnetic sensor may move according to the size of the conveyance sheet. When the position of the specific image on the conveyance sheet is previously identified, the magnetic sensor may be disposed according to the position of the specific image.

The first distinguishing portion (a first distinguishing sensor or first distinguishing sensor arrangement) 33 detects magnetism on one surface of the conveyance sheet. The second distinguishing portion 34 (a second distinguishing sensor or second distinguishing sensor arrangement) detects magnetism on a surface on the side opposite to the surface where the first distinguishing portion 33 performs detection. The first distinguishing portion 33 and the second distinguishing portion 34 detect magnetism using the magnetic sensor and distinguish the first sheet and the second sheet from each other. The first distinguishing portion 33 and the second distinguishing portion 34 distinguish that the conveyance sheet is the first sheet when the detected value of the magnetic sensor is a threshold value or more. The first distinguishing portion 33 and the second distinguishing portion 34 distinguish that the conveyance sheet is the second sheet when the detected value of the magnetic sensor is less than the threshold value.

The paper discharge portion 38 includes a first paper discharge tray 42 and a second paper discharge tray 43. The conveyance sheet is discharged to the first paper discharge tray 42 or the second paper discharge tray 43 based on the distinguishing result of the first distinguishing portion 33 and the second distinguishing portion 34. When the conveyance sheet is distinguished to be the first sheet by the first distinguishing portion 33 and the second distinguishing portion 34, the separating device 50 discharges the first sheet to the first paper discharge tray 42. When the conveyance sheet is distinguished to be the second sheet by the first distinguishing portion 33 and the second distinguishing portion 34, the separating device 50 discharges the second sheet to the second paper discharge tray 43.

The decolorizing device included in the decolorizing system of some embodiments includes a heating portion capable of heating the sheet to a temperature equal to or higher than the decolorizing temperature (Th). In the decolorizing system of some embodiments, the decolorizing device heats the first sheet separated into the first paper discharge tray 42 by the separating device 50. Then, the decolorizing device decolorizes the image including a fixed material of the decolorizable toner of some embodiments.

According to the decolorizing system of some embodiments, a sheet which can be reused and a sheet which is hardly reused can be easily distinguished from each other by detecting the presence or absence of magnetism of the sheet. As a result, the users' convenience is improved.

According to the decolorizing system of some embodiments, even if the first sheet and the second sheet are present mixedly, the first sheet can be selectively heated, and there is no need to perform a decolorizing treatment of the second sheet, i.e., selective heating is only performed for the first sheet.

According to the decolorizing system of some embodiments, as compared with the case where the decolorizing treatment is performed by heating the first sheet and the second sheet, the energy efficiency of the decolorizing treatment is improved. This is because the image on the second sheet is hardly decolorized by heating, and therefore, when the second sheet is heated, energy loss is likely to occur.

Hereinafter, a decolorizing method of some embodiments will be described with reference to the drawing.

By the decolorizing system of some embodiments, for example, an image including a fixed material of the decolorizable toner of some embodiments is decolorized as follows.

Figure 3:
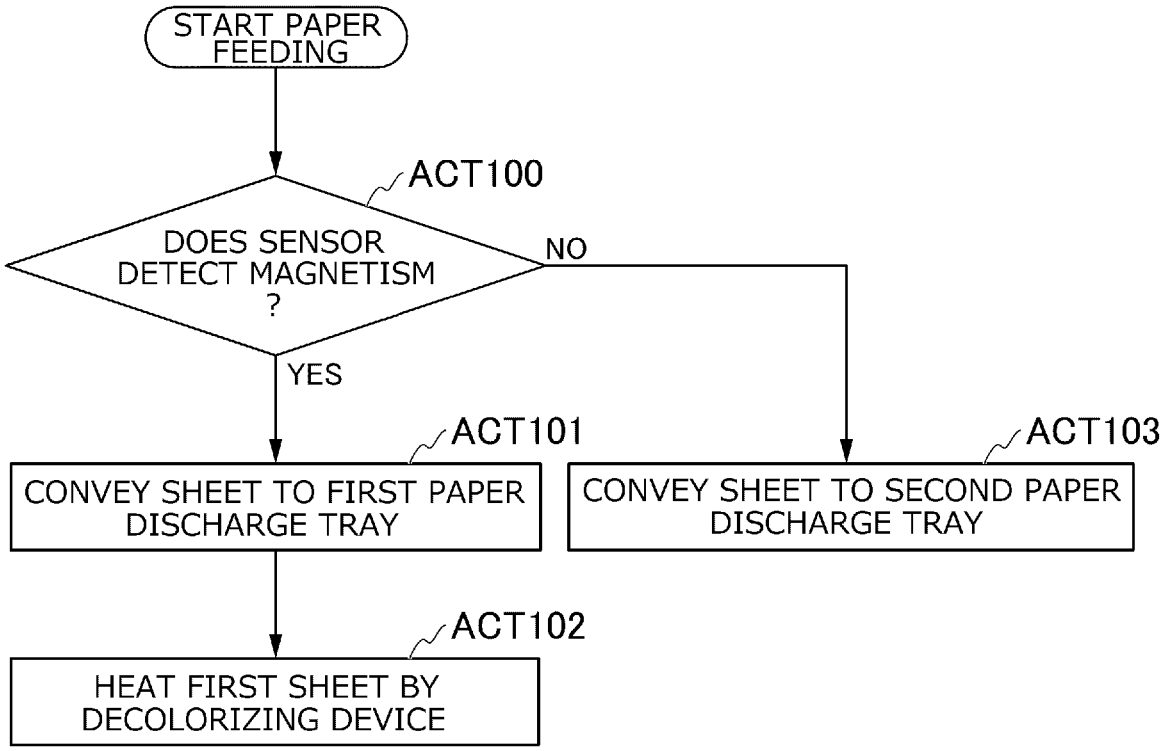
FIG. 3 shows a flowchart of the decolorizing system according to some embodiments.

FIG. 3 shows a flowchart of the decolorizing system of some embodiments.

First, paper feeding of the conveyance sheet is started from the paper feed tray 39. Subsequently, with respect to the conveyance sheet, magnetism is detected by the first distinguishing portion 33 and the second distinguishing portion 34 (ACT 100). Based on the presence or absence of magnetism, a sheet on which an image including a fixed material of the decolorizable toner of some embodiments is formed is separated.

When at least one of the first distinguishing portion 33 and the second distinguishing portion 34 detects magnetism from the conveyance sheet, the conveyance sheet is distinguished to be the first sheet. In this case, the first sheet is conveyed to the first paper discharge tray 42 (ACT 101). Thereafter, the first sheet in the first paper discharge tray 42 is heated by the decolorizing device included in the decolorizing system of some embodiments (ACT 102). As a result, the image on the first sheet is decolorized.

Neither of the first distinguishing portion 33 and the second distinguishing portion 34 detects magnetism from the conveyance sheet or the detected value is less than the threshold value, the conveyance sheet is distinguished to be the second sheet. In this case, the second sheet is conveyed to the second paper discharge tray 43 (ACT 103).

According to the decolorizing method of some embodiments, a sheet which can be reused and a sheet which is hardly reused can be easily distinguished from each other by detecting the presence or absence of magnetism of the sheet. As a result, the users' convenience is improved.

According to the decolorizing method of some embodiments, even if the first sheet and the second sheet are present mixedly, the first sheet can be selectively heated, and there is no need to perform a decolorizing treatment of the second sheet. As a result, the energy efficiency of the decolorizing treatment is improved.

Hereinafter, a decolorizing device of some embodiments will be described with reference to the drawing. In the following description, among the components of the decolorizing device and the components of the separating device, components having the same or a similar function are denoted by the same reference numeral. Then, the description of the overlapping components between the decolorizing device and the separating device is omitted.

Figure 4:
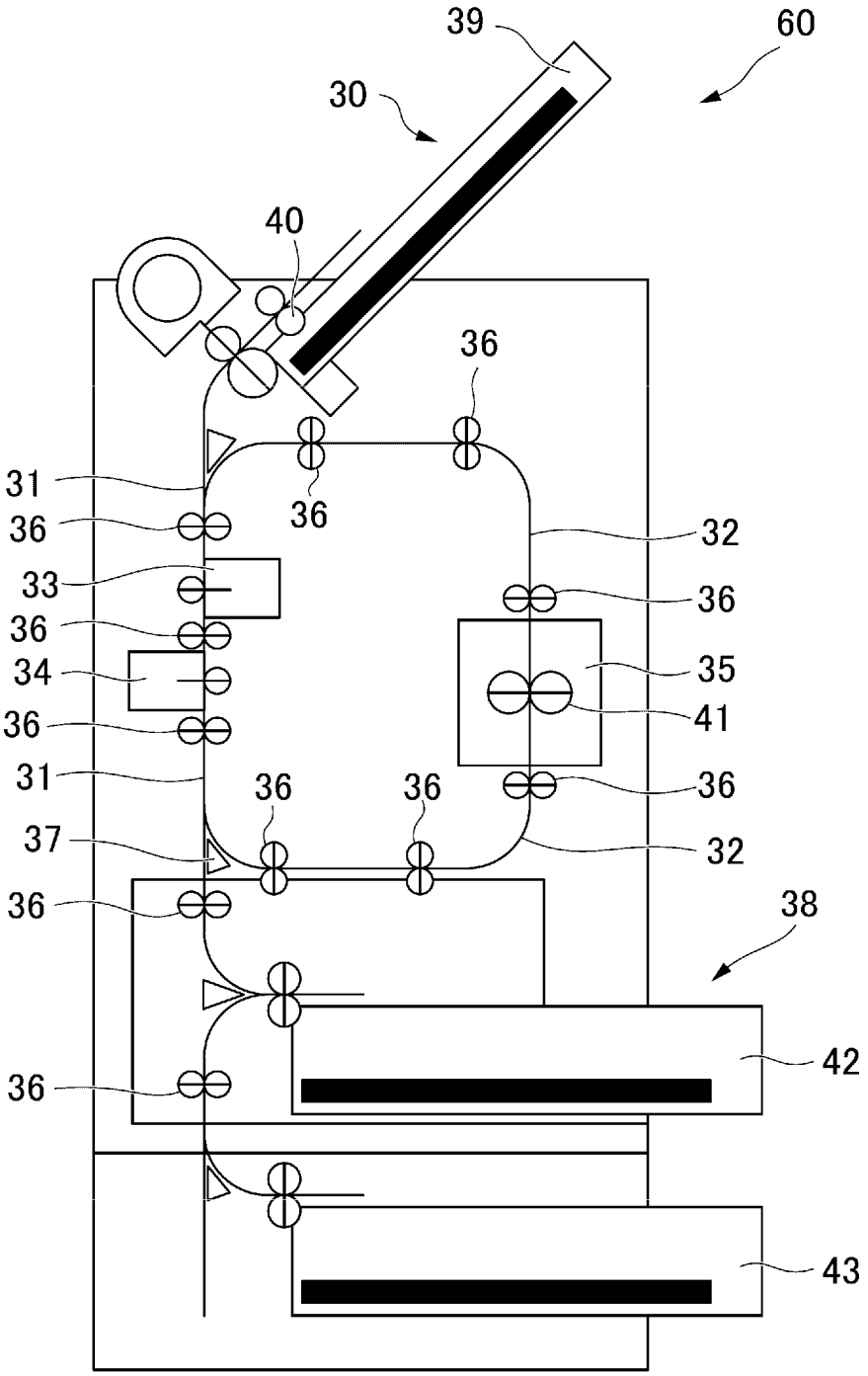
FIG. 4 shows a decolorizing device according to some embodiments.

FIG. 4 is a diagram showing an exemplary schematic structure of the decolorizing device of some embodiments.

A decolorizing device 60 decolorizes an image on a sheet on which the image is formed by the image forming apparatus and enables the reuse of the sheet. The decolorizing device 60 includes a paper feed portion 30, a first conveyance path 31, a second conveyance path 32, a first distinguishing portion 33, a second distinguishing portion 34, a decolorizing portion (a decolorizer) 35, a path changing portion (a path changer) 37, and a paper discharge portion 38.

The paper feed portion 30 feeds a sheet into the decolorizing device 60.

The second conveyance path 32 includes a plurality of conveyance rollers 36. The second conveyance path 32 branches off from the first conveyance path 31 at a branching point downstream of the first distinguishing portion 33 and the second distinguishing portion 34. The second conveyance path 32 meets the first conveyance path 31 at a meeting point upstream of the first distinguishing portion 33 and the second distinguishing portion 34. The second conveyance path 32 includes the decolorizing portion 35. The path changing portion 37 is disposed at the branching point downstream of the first distinguishing portion 33 and the second distinguishing portion 34. The path changing portion 37 changes the path of the conveyance sheet to the second conveyance path 32 based on the distinguishing result of the first distinguishing portion 33 and the second distinguishing portion 34.

The decolorizing portion 35 includes a roller pair 41 and a heater (not shown). The roller pair 41 is heated by the heater. The decolorizing portion 35 applies heat to the sheet through the heated roller pair 41, and decolorizes an image including a fixed material of the decolorizable toner of some embodiments. The decolorizing portion 35 can decolorize the image on both surfaces of the sheet by decolorizing the image with the roller pair 41.

The conveyance sheet is discharged to the first paper discharge tray 42 or the second paper discharge tray 43. For example, the tray may be made selectable such that the first sheet is discharged to the first paper discharge tray 42, and the second sheet is discharged to the second paper discharge tray 43.

When the conveyance sheet is distinguished to be the first sheet by the first distinguishing portion 33 and the second distinguishing portion 34, the path changing portion 37 changes the path of the conveyance sheet to the second conveyance path 32. In this case, the decolorizing device 60 performs a decolorizing treatment of the first sheet by the decolorizing portion 35. The decolorizing device 60 discharges the first sheet after the decolorizing treatment to the first paper discharge tray 42.

When the conveyance sheet is distinguished to be the second sheet by the first distinguishing portion 33 and the second distinguishing portion 34, the path changing portion 37 changes the path of the conveyance sheet to the first conveyance path 31. In this case, the decolorizing device 60 discharges the second sheet to the second paper discharge tray 43.

According to the decolorizing device of some embodiments, a sheet which can be reused and a sheet which is hardly reused can be easily distinguished from each other. As a result, the users' convenience is improved.

According to the decolorizing device of some embodiments, even if the first sheet and the second sheet are present mixedly, the first sheet can be selectively heated, and there is no need to perform a decolorizing treatment of the second sheet. As a result, the energy efficiency of the decolorizing treatment is improved.

Hereinafter, some embodiments will be more specifically described by the following non-limiting Examples.

A decolorizable toner of Example 1 was produced as follows.

The air in a four-necked flask equipped with a nitrogen inlet tube, a dehydration tube, a stirrer, and a thermocouple was replaced with nitrogen. In the four-necked flask, the raw materials of an amorphous polyester resin A shown below were placed, and the temperature was raised to 210° C. in a nitrogen atmosphere, and the raw materials of an amorphous polyester resin A were reacted to one another at 210° C. Subsequently, a condensation reaction was performed under reduced pressure at 8.3 KPa until a desired softening point was attained, whereby the amorphous polyester resin A was obtained.

The composition of the raw materials of the amorphous polyester resin A is as follows.

| | |
|---|---|
| polyoxypropylene(2.2)-2,2-bis(4-hydroxy-phenyl)propane | 4900 g |
| polyoxyethylene(2.0)-2,2-bis(4-hydroxy-phenyl)propane | 1950 g |
| fumaric acid | 2088 g |
| adipic acid | 292 g |
| tert-butyl catechol | 10 g |
| tin octylate | 50 g |

The softening point of the amorphous polyester resin A was 91° C. The glass transition point of the amorphous polyester resin A was 51° C. The acid value of the amorphous polyester resin A was 16 mg KOH/g.

The softening point was measured using a flow tester "CFT-500D (manufactured by Shimadzu Corporation)". A point on a curve which corresponds to a plunger descending amount of 2 mm on a flow chart is taken as the softening point. The measurement conditions are as follows.

Temperature raising rate: 2.5° C./min

Load: 10 kg

Orifice diameter: 1 mm

Measurement method: The softening point was measured as a melting temperature Tm by a temperature raising method. The melting temperature Tm according to the temperature raising method is a temperature when a molten material of a sample flows out by 2 mm by raising the temperature of the sample from 30° C.

The glass transition point was measured using a differential scanning calorimeter "DSC Q2000 (manufactured by TA Instruments, Inc.)". The measurement conditions are as follows.

Sample amount: 5 mg

Lid and pan: alumina

Temperature raising rate: 10° C./min

Measurement method: The temperature of a sample is raised from 20° C. to 200° C. Thereafter, the sample is cooled to 20° C. or lower. Then, the sample is heated again, and the maximum endothermic peak measured in a temperature range from 60 to 80° C. is defined as the glass transition point.

The acid value is the amount of potassium hydroxide in milligrams (mg) required to neutralize the acidic components contained in one gram of a sample. The acid value was measured in accordance with JIS K 0070.

An amorphous polyester resin B was obtained in the same manner as the amorphous polyester resin A except that the raw material composition was changed as shown below.

The composition of the raw materials of the amorphous polyester resin B is as follows.

| | |
|---|---|
| polyoxypropylene(2.2)-2,2-bis(4-hydroxy-phenyl)propane | 4900 g |
| polyoxyethylene(2.0)-2,2-bis(4-hydroxy-phenyl)propane | 1950 g |
| fumaric acid | 1728 g |
| adipic acid | 672 g |
| trimellitic anhydride | 384 g |
| tert-butyl catechol | 10 g |
| tin octylate | 50 g |

The softening point of the amorphous polyester resin B was 102° C. The glass transition point of the amorphous polyester resin B was 51° C. The acid value of the amorphous polyester resin B was 33 mg KOH/g.

The raw materials of a binder resin dispersion liquid A shown below were stirred at 200 r/min in a 5-L stainless steel pot and dispersed at 25° C., and thereafter the temperature was raised to 90° C. The contents of the stainless steel pot was stabilized at 90° C. and maintained for 2 hours while stirring. Subsequently, 1076 g of deionized water was added dropwise thereto at 6 g/min, whereby an emulsion was obtained. The emulsion was cooled, and then passed through a wire mesh, whereby the binder resin dispersion liquid A was obtained.

The composition of the raw materials of the binder resin dispersion liquid A is as follows.

| | |
|---|---|
| the amorphous polyester resin A | 390 g |
| the amorphous polyester resin B | 210 g |
| an anionic surfactant "Neopelex G-15 (manufactured by Kao Corporation)", sodium dodecylbenzene sulfonate (solid content: 15 mass %) | 40 g |
| a nonionic surfactant "Emulgen 430 (manufactured by Kao Corporation)", polyoxyethylene (26 mol) oleyl ether | 6 g |
| an aqueous solution of 5 mass % potassium hydroxide | 218 g |

The volume median particle diameter of the resin fine particles of the binder resin dispersion liquid A was 0.16 μm. The solid content concentration of the binder resin dispersion liquid A was 32 mass %.

The volume median particle diameter was measured using a particle size distribution analyzer based on a pore electrical resistance method "Multisizer 3 (manufactured by Beckman Coulter Inc.)"

The raw materials of a release agent dispersion liquid shown below were placed in a 1-L beaker. The contents of the beaker were treated with an ultrasonic homogenizer US-600T (trade name, manufactured by Nissei Corporation) and dispersed while maintaining the contents at 90 to 95° C. After the resulting dispersion liquid was cooled, deionized water was added thereto to adjust the solid content to 20 mass %, whereby the release agent dispersion liquid was obtained.

The composition of the raw materials of the release agent dispersion liquid is as follows.

| | |
|---|---|
| carnauba wax | 120 g |
| deionized water | 480 g |
| an aqueous solution of dipotassium alkenyl succinate (trade name: Latemul ASK, manufactured by Kao Corporation, effective concentration: 28 mass %) | 4.3 g |

The volume median particle diameter of the release agent dispersion liquid was 0.42 μm.

77 g of titanium oxide (R-820, manufactured by Ishihara Sangyo Kaisha, Ltd.) and 23 g of a magnetite powder were treated with a sand mill for 2 hours, whereby a white magnetic material powder was obtained. 100 g of the magnetic material powder, 40 g of an anionic surfactant "Neopelex G-15 (manufactured by Kao Corporation)", sodium dodecylbenzene sulfonate (solid content: 15 mass %), and 860 g of ion exchanged water were mixed and ground with a bead mill for 6 hours, whereby a white magnetic material dispersion liquid was obtained. The particle diameter of the fine particles in the white magnetic material dispersion liquid was 0.45 μm.

In order to forma coloring material, components composed of 5 parts of CVL (crystal violet lactone) as a leuco dye, 5 parts of benzyl 4-hydroxybenzoate as a color developing agent, and 50 parts of 4-benzyloxyphenylethyl laurate as a color change temperature regulator (decolorizing agent) were heated and melted. Subsequently, this heated and melted material was added into 250 parts of an aqueous solution of 8% polyvinyl alcohol along with an encapsulating agent (a mixed solution of 20 parts of an aromatic polyvalent isocyanate prepolymer and 40 parts of ethyl acetate), and emulsified and dispersed, and stirring was continued at 70° C. for about 1 hour. Thereafter, 2 parts of a water-soluble aliphatic modified amine was added thereto as a reaction agent, and stirring was continued for about 3 hours while maintaining the temperature of the liquid at 90° C., whereby a colorless capsule particle dispersion liquid was obtained.

The capsule particle dispersion liquid was placed in a freezer (−30° C.) to develop a color, whereby a blue colored particle dispersion was obtained. The colored particles of the colored particle dispersion were measured using "SALD-7000" manufactured by Shimadzu Corporation. As a result, the volume median particle diameter of the colored particle dispersion was 2 μm. The completely decolorizing temperature Th of the colored particle dispersion was 79° C. The completely coloring temperature Tc of the colored particle dispersion was −20° C.

The "completely decolorizing temperature" is a temperature when an image density in a completely decolorized state (a state where the color developable compound and the color developing agent are not associated with each other and a color based on the association is not developed) is exhibited. The "completely coloring temperature" is a temperature when the highest image density is exhibited.

Toner raw materials shown below were mixed, and further, 164 parts of an aqueous solution of 11% ammonium sulfate [$(NH_4)_2SO_4$] was added thereto, whereby the toner raw materials were aggregated.

The composition of the toner raw materials is as follows.

the capsule particle dispersion liquid (containing 10 parts of the encapsulated coloring material) 100 parts the binder resin dispersion liquid A (containing 80 parts of the binder resin) 266 parts the release agent dispersion liquid (containing 5 parts of the release agent) 25 parts the white magnetic material dispersion liquid (containing 5 parts of the white magnetic material) 50 parts Subsequently, an aqueous solution of an oxazoline group-containing acrylic polymer ("EPOCROS WS-700", manufactured by Nippon Shokubai Co., Ltd., polymer content: 25%) was added thereto so that the ratio of the polymer content to the toner solid content was 7.2%. Then, 250 parts of an anionic surfactant (EMAL E-27C, manufactured by Kao Corporation) at 2.5 mass % was added thereto, and the temperature was raised to 65° C. and maintained for 2 hours, whereby a toner particle dispersion liquid of Example 1 was obtained. After cooling, the toner particle dispersion liquid was dehydrated, and the toner particles were washed and dried. The volume median particle diameter of the toner particles of Example 1 was 6.6 μm. The volume median particle diameter of the toner particles was measured using a Coulter counter (aperture diameter: 50 μm, measurement particle diameter range: 1.0 to 30 μm).

With respect to 100 parts of the toner particles of Example 1, 3.5 parts of hydrophobic silica (trade name: NAX50, manufactured by Japan Aerosil Co., Ltd.) was externally added and mixed, whereby a decolorizable toner of Example 1 was obtained.

The decolorizable toner of Example 1 was housed in a copier LOOPS LP30 manufactured by Toshiba Corporation and a solid image was printed on a sheet. The sheet having the solid image printed thereon was fed in a paper conveying device equipped with a magnetic sensor. When the solid image passed through the magnetic sensor, the output waveform of the magnetic sensor was obtained.

A decolorizable toner of Comparative Example 1 was produced in the same manner as in Example 1 except that the white magnetic material dispersion liquid was not added to the toner raw materials.

The decolorizable toner of Comparative Example 1 was housed in LOOPS LP30 and a solid image was printed on a sheet in the same manner as in Example 1. The sheet having the solid image printed thereon was fed in the paper conveying device. In Comparative Example 1, when the solid image passed through the magnetic sensor, the output waveform of the magnetic sensor was not obtained.

The sheet printed using the decolorizable toner of Example 1 could be easily detected by the output waveform of the magnetic sensor. Therefore, a sheet which can be reused was easily distinguished.

On the other hand, the sheet printed using the decolorizable toner of Comparative Example 1 could not be detected by the output waveform of the magnetic sensor.

According to at least one embodiment described above, the decolorizable toner of some embodiments has magnetism, and therefore, magnetism can be imparted to a sheet after printing. As a result, by distinguishing a sheet using magnetism, a sheet which can be reused and a sheet which is hardly reused can be easily distinguished from each other.

While several embodiments of the invention have been described, these embodiments are presented by way of example only and are not intended to limit the scope of the invention. The novel embodiments described herein can be embodied in various other forms, and various omissions, substitutions, and changes can be made without departing from the gist of the invention. Some embodiments and modifications thereof are included in the scope and gist of the invention and also included in the invention described in the claims and in the scope of their equivalents.

What is claimed is:

1. A decolorizing system, comprising:

a separator including a magnetic sensor configured to detect a presence or an absence of an image including a fixed material of a decolorizable toner comprising:

a color developable compound comprising a precursor compound of a dye;

a color developing agent which is an electron accepting compound capable of donating a proton to the color developable compound;

a decolorizing agent which is a compound capable of inhibiting a coloring reaction between the color developable compound and the color developing agent;

magnetic material; and a binder resin;

the separator being configured to separate a sheet on which the image is formed; and a decolorizer configured to decolorize the image.

2. A decolorizing device, comprising:

a distinguishing sensor arrangement comprising a magnetic sensor, the magnetic sensor being configured:

to detect a presence or an absence of an image including a fixed material of a decolorizable toner comprising:

a color developable compound comprising a precursor compound of a dye;

a color developing agent which is an electron accepting compound capable of donating a proton to the color developable compound;

a decolorizing agent which is a compound capable of inhibiting a coloring reaction between the color developable compound and the color developing agent;

magnetic material; and a binder resin; and to distinguish whether or not the image is formed; and a decolorizer configured to decolorize the image.

3. A decolorizing device, comprising:

a distinguishing sensor configured:

to detect a presence or an absence of an image including a fixed material of a decolorizable toner comprising:

a color developable compound comprising a precursor compound of a dye;

a color developing agent which is an electron accepting compound capable of donating a proton to the color developable compound;

a decolorizing agent which is a compound capable of inhibiting a coloring reaction between the color developable compound and the color developing agent;

magnetic material; and a binder resin; and to distinguish from each other a first sheet on which the image is formed and a second sheet on which the image is not formed; and a decolorizer configured to decolorize the image formed on the first sheet.

* * * * *